US007416053B2

(12) United States Patent
Chard et al.

(10) Patent No.: US 7,416,053 B2
(45) Date of Patent: Aug. 26, 2008

(54) ISOLATION MECHANISM FOR ELECTRICALLY ISOLATING CONTROLS OF BOOMED APPARATUS

(75) Inventors: Joshua T. Chard, Birmingham, AL (US); Edman R. Blair, St. Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 714 days.

(21) Appl. No.: 10/664,622

(22) Filed: Sep. 17, 2003

(65) Prior Publication Data

US 2004/0055817 A1 Mar. 25, 2004

Related U.S. Application Data

(62) Division of application No. 10/103,433, filed on Mar. 20, 2002.

(51) Int. Cl.
*B66F 11/00* (2006.01)

(52) U.S. Cl. ..... 182/2.4; 182/2.9

(58) Field of Classification Search ..... 182/2.1–2.11, 182/18, 46

See application file for complete search history.

(56) References Cited

U.S. PATENT DOCUMENTS 3,320,524 A * 5/1967 Miller, Jr. ..... 324/557
3,489,243 A * 1/1970 Stilwell et al. ..... 182/46
3,757,895 A * 9/1973 Knutson ..... 182/46
3,842,458 A * 10/1974 Bauer ..... 7/134
3,844,378 A * 10/1974 Balogh ..... 182/141
3,985,041 A * 10/1976 Gilmore ..... 74/502.5
4,762,199 A * 8/1988 Holmes ..... 182/2.9
4,784,278 A * 11/1988 Luscombe ..... 212/292

* cited by examiner

*Primary Examiner*—Alvin C Chin-Shue
(74) *Attorney, Agent, or Firm*—Hovey Williams LLP

(57) ABSTRACT

An isolation mechanism for electrically isolating a control input mechanism of an otherwise substantially conventional boomed apparatus (12), such as, for example, an aerial device, digger derrick, or crane, having a workstation (14) coupled with a movable boom (16), wherein the isolation mechanism allows a worker to control movement of the boom (16) and positioning of the work station (14) while protecting against electrical discharge along substantially any path which includes the control input mechanism. In a first embodiment, the isolation mechanism takes the form of an improved control input mechanism (10), portions of which are constructed of or covered with an electrically non-conducting material. In a second embodiment, the isolation mechanism takes the form of a boom extension (110) constructed of or covered with electrically non-conductive material. In a third embodiment, the improved control input mechanism (10) and the boom extension (110) are combined.

4 Claims, 5 Drawing Sheets

ISOLATION MECHANISM FOR ELECTRICALLY ISOLATING CONTROLS OF BOOMED APPARATUS

RELATED APPLICATIONS

The present patent application is a divisional patent application claiming priority benefit of an earlier-filed, copending U.S. non-provisional patent application titled ISOLATION MECHANISM FOR ELECTRICALLY ISOLATING CONTROLS OF BOOMED APPARATUS; Ser. No. 10/103,433; filed: Mar. 20, 2002. The identified earlier-filed, copending patent application is hereby incorporated by reference into the present application.

BACKGROUND OF THE INVENTION

1. Field of the Invention

The present invention relates to isolation mechanisms for electrically isolating control input mechanisms of boomed apparatuses. More particularly, the present invention concerns an isolation mechanism for electrically isolating a control input mechanism of an otherwise substantially conventional boomed apparatus, such as, for example, an aerial device, digger derrick, or crane, having a workstation coupled with a movable boom, wherein the isolation mechanism allows a worker to control movement of the boom and positioning of the work station while protecting against electrical discharge along substantially any path which includes the control input mechanism.

2. Description of the Prior Art

It is often desirable, particularly in the electric utility industry, to provide a boomed apparatus, such as, for example, an aerial device, digger derrick, or crane, operable to facilitate work at or from an elevated position. Such a boomed apparatus is embodied in, for example, a common bucket truck operable to facilitate work high on an electric utility pole or on a wall of a building.

Typically, a bucket truck broadly comprises a work station; a movable boom; a vehicular platform; a control input mechanism; and a control assembly. The work station is operable to lift or otherwise carry at least one worker to the elevated work site, and is coupled with the boom at or near a distal end thereof. Because the work station may be used near highly-charged electrical lines or devices, the work station must be electrically isolated so as to prevent damaging electrical discharge or electrocution of the worker. Thus, the work station is commonly provided with a protective, non-conductive liner so that the worker, as long as he or she remains completely inside the work station and liner, is protected from electrocution.

The boom is movable so as to elevate and otherwise position the work station where desired, and is coupled with the vehicular platform at or near a base end of the boom which is substantially opposite the distal end. Commonly, in order to further electrically isolate the work station from electrical discharge via the boom and the vehicular platform, an intermediate portion or section of the boom is constructed of or covered with an electrically non-conductive, or dielectric, material. The distal end of the boom, however, though electrically isolated from the vehicular platform, must incorporate structural material so as to have sufficient structural strength to support the work station and worker. This structural material is typically an electrically conductive metal, such as steel, with the work station and control assembly being directly exposed or dangerously close thereto.

The vehicular platform is motorized and wheeled or otherwise adapted to quickly and efficiently travel to and from the work site. The vehicular platform will either be in direct contact with an electrical ground, such as, for example, the Earth, or imminently at risk of direct or indirect contact therewith.

The control input mechanism allows the elevated worker to provide a control input to control, via the control assembly, movement of the boom and positioning of the work station. Commonly, the control assembly comprises one or more hydraulic control valves, one or more fluid conduits and a quantity of hydraulic fluid, to transmit the control input down the boom for implementation. The necessary conduit connections, however, prevent the control valves from being located inside the work station and its protective liner. Furthermore, as the control input mechanism must be in direct physical contact with the control assembly in order to actuate the valves in accordance with the control input, the control input mechanism must also be located outside the work station and protective liner. Thus, the worker must reach outside the protective liner to actuate the control input mechanism, thereby exposing him or herself to electrocution. This is of particular concern given that the control valves to which the control input mechanism is coupled are typically constructed of an electrically conductive material. Furthermore, the control valves may be located in close proximity to the aforementioned electrically conductive structural support material used to reinforce the distal end of the boom.

Thus, although the aforementioned dielectric boom portion does protect against electrical discharge via the boom and vehicular platform, it does not protect against direct discharge via the electrically conductive structural material in the distal end of the boom, via the control valves, and via the control input mechanism, thereby leaving the worker vulnerable to damaging or deadly phase-to-phase or phase-to-ground electrical discharge along these paths. For example, were the work station or distal end of the boom to move into or otherwise come into contact with a first phase or ground conductor while the worker is in contact with the control input mechanism and second conductor, the worker would be electrocuted. In this case, the discharge path is from the first conductor, to the distal end of the boom, to the control input mechanism, to the worker, and to the second conductor. It will be appreciated that the dielectric boom portion provides no protection against this or similar discharge paths.

Due to the aforementioned problems and disadvantages in the prior art, a need exists for an improved isolation mechanism for protecting the worker against electrical discharge along substantially any path which includes the control input mechanism.

SUMMARY OF THE INVENTION

The present invention overcomes the above-identified and other problems and disadvantages in the prior art by providing a distinct advance in the art of isolation mechanisms for boomed apparatuses. More particularly, the present invention concerns an isolation mechanism for electrically isolating a control input mechanism of an otherwise substantially conventional boomed apparatus, as was described above in detail, wherein the isolation mechanism allows a worker to control movement of the boom and positioning of the work station while protecting against electrical discharge along substantially any path which includes the control input mechanism.

The isolation mechanism of the present invention is provided in three embodiments. In each embodiment, the isolation mechanism provides for electrically non-conductive materials to be interposed between a control handle portion of the control input mechanism and the electrically conductive structural materials or the control assembly components. In the first embodiment, specific existing conventional components constructed of an electrically conductive material are strategically replaced with components constructed of or covered with an electrically non-conductive material. In the second embodiment, a new component constructed of or covered with an electrically non-conductive material is introduced. In the third embodiment, the first and second embodiments are combined to provide maximum protection.

More specifically, in the first embodiment, the isolation mechanism takes the form of an improved control input mechanism, which broadly comprises the control handle and a linkage. The control handle is grasped by the worker and allows him or her to provide the control input for controlling movement of the boom and positioning of the work station. The linkage couples the control handle with the control valves and operates to transmit the control input therebetween for implementation. Portions of the control handle and the linkage are constructed of or covered with an electrically non-conductive material so as to provide a dielectric gap separating the control handle from the electrically conductive structural materials and the electrically conductive control valves, thereby substantially reducing or eliminating any risk of electrocution along these paths.

In the second embodiment, the isolation mechanism takes the form of a boom extension, or "mini-boom", constructed of or covered with an electrically non-conductive material and interposed between the distal end of the boom, with its electrically conductive structural materials, and a conventional control input mechanism located at or near the workstation. Because the fluid conduits of the control assembly are considered to be electrically non-conductive, the electrically conductive control valves can be located inside the boom extension near the control input mechanism, such that the fluid conduits extend through the boom extension. Thus, a dielectric gap is provided by the boom extension and fluid conduits, which separates the control handle and the control valves from the electrically conductive structural materials, thereby substantially reducing or eliminating any risk of electrocution along these paths.

As mentioned, in the third embodiment, the isolation mechanism combines the improved control input mechanism of the first embodiment with the boom extension of the second embodiment, thereby providing double protection against risks of electrocution and otherwise damaging electrical discharge.

It will be appreciated that the isolation mechanism of the present invention provides for substantial advantages over the prior art, including, for example, that the worker is protected against electrical discharge along substantially all paths which include the control input mechanism and, more particularly, the control handle. This is a substantial improvement over the prior art which protects only against electrical discharge via the boom and vehicle platform.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Referring to FIGS. 1-4, an isolation mechanism in the form of an improved control input mechanism 10 is shown constructed in accordance with a preferred first embodiment of the present invention. A preferred second embodiment and a preferred third embodiment are also discussed, below. The improved control input mechanism 10 may be used on any otherwise conventional boomed apparatus, such as, for example, an aerial device, digger derrick, or crane, or, as shown, a common bucket truck 12, having an electrically isolated work station 14 coupled with a moveable boom 16. The improved control input mechanism 10 is operable to allow a worker to control movement of the boom 16 and positioning of the work station 14 while protecting against electrical discharge along substantially any path which includes the improved control input mechanism 10.

As used herein, an electrically non-conductive material is any suitably insulative or dielectric material, including, for example, fiberglass, rubber, plastic, carbon fiber, and nylon, or combination of such materials through which electricity, of a voltage and frequency typically encountered in the electric and communication utility industries, will not substantially flow.

Figure 1:
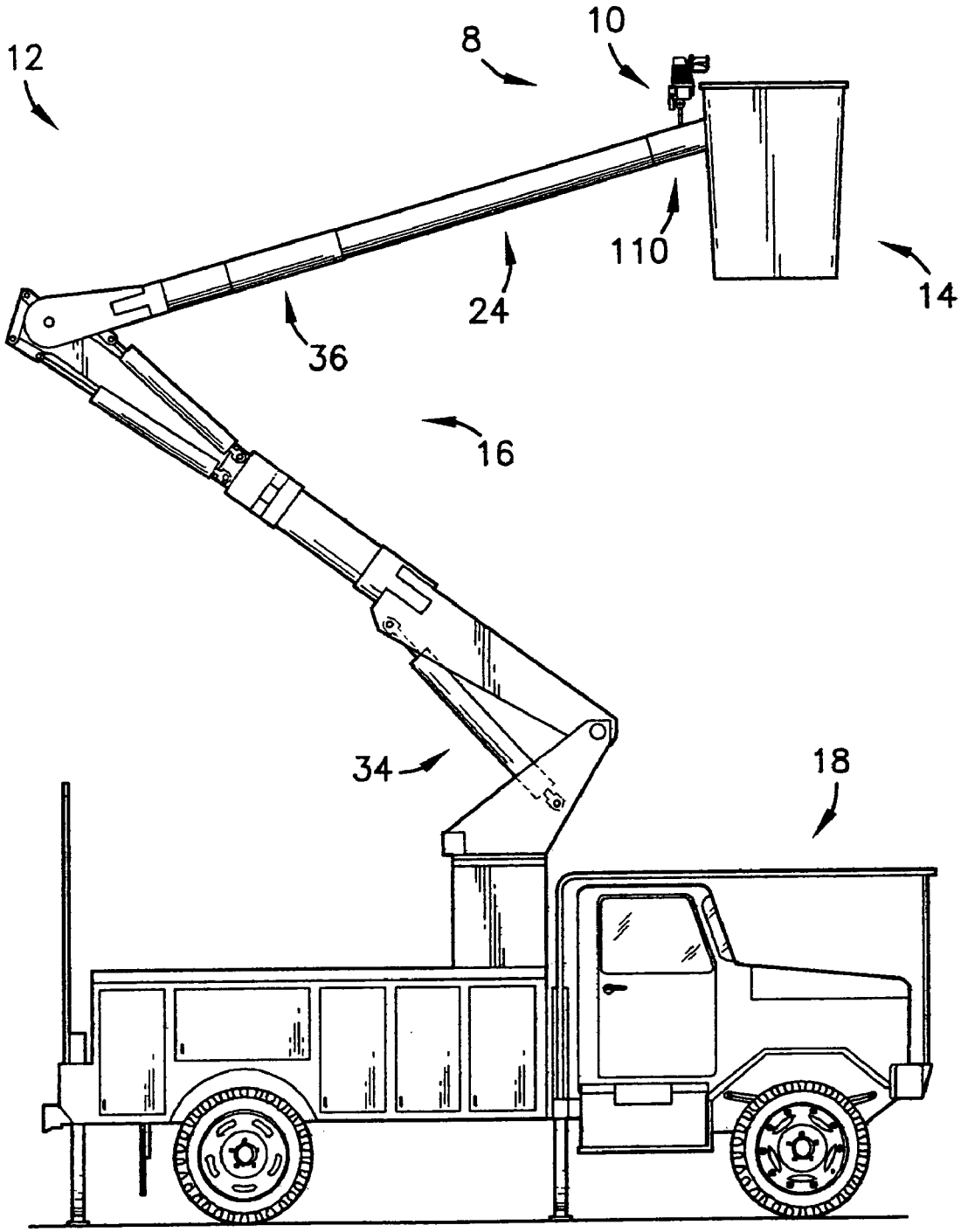
FIG. 1 is a plan view of a common bucket truck showing a preferred third embodiment of the isolation mechanism of the present invention.
Figure 2:
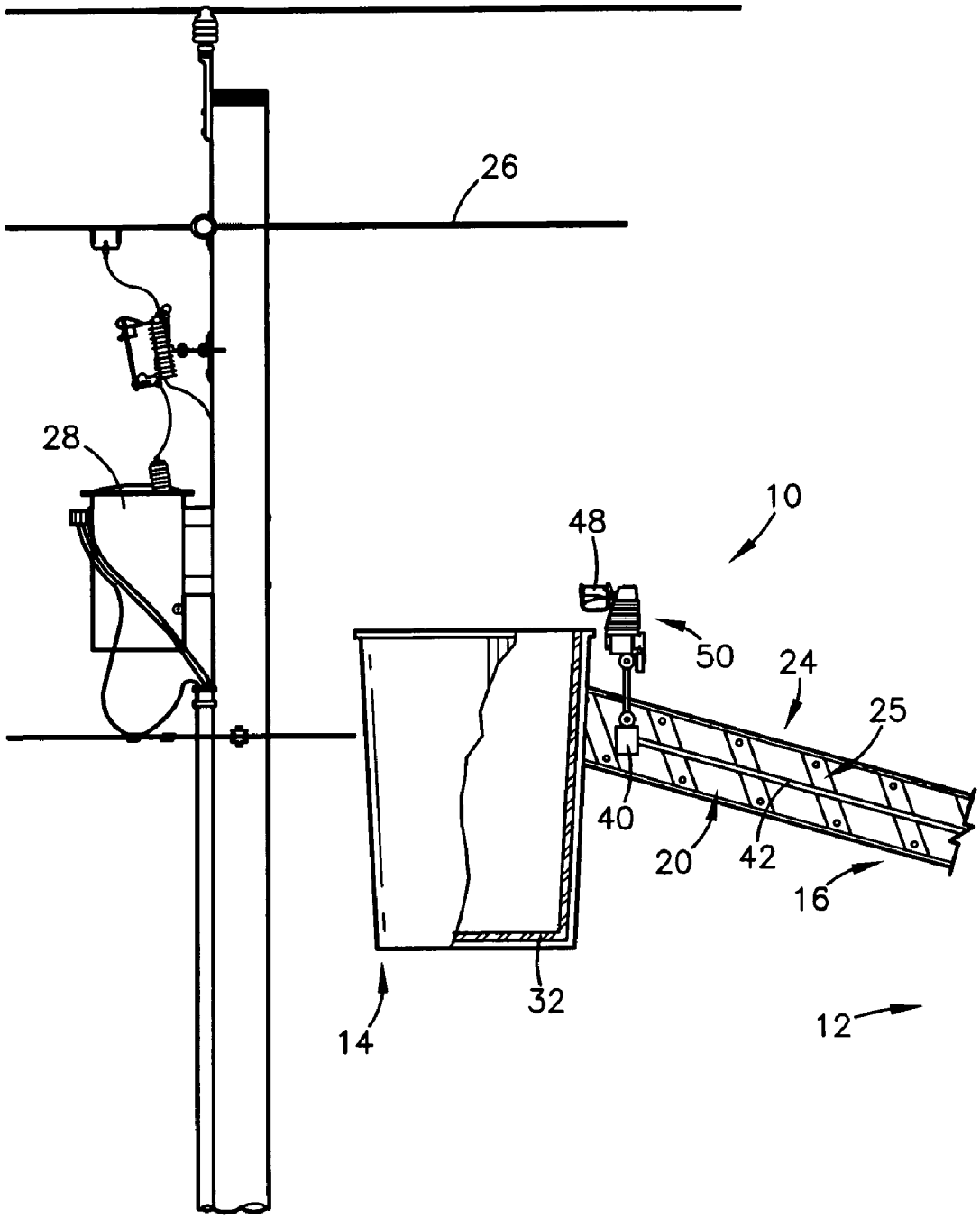
FIG. 2 is a fragmentary sectional view showing a preferred first embodiment of the isolation mechanism of the present invention as it relates to the bucket truck of FIG. 1.

By way of background, referring particularly to FIGS. 1 and 2, the common bucket truck 12 typically comprises the work station 14; the movable boom 16; a vehicular platform 18; and a control assembly 20. The work station 14 is operable to lift or otherwise carry at least one worker to the elevated work site, and is coupled with the boom 16 at or near a distal end 24 thereof. Because the work station 14 may be used near highly-charged electrical lines 26 or devices 28, the work station 14 must be electrically isolated so as to prevent damaging electrical discharge or electrocution of the worker. Thus, the workstation 14 is commonly provided with a protective, non-conductive liner 32 so that the worker, as long as he or she remains completely inside the work station 14, is protected from electrocution.

The boom 16 is movable so as to elevate and otherwise position the work station 14 where desired, and is coupled with the vehicular platform 18 at or near a base end 34 of the boom 16 which is substantially opposite the distal end 24. Commonly, in order to further electrically isolate the work station 14 from electrical discharge via the boom 16 and the vehicular platform 18, at least an intermediate portion 36 or section of the boom 16 is constructed of or covered with an electrically non-conductive material. The distal end 24 of the boom 16, however, though electrically isolated from the vehicular platform 18, must incorporate steel or other structural material 25 so as to have sufficient structural strength to support the work station 14 and worker. This structural material 25 is typically an electrically conductive metal, with the work station 14 being directly exposed or dangerously close thereto.

The vehicular platform 18 is motorized and wheeled or otherwise adapted to quickly and efficiently travel to and from the work site. The vehicular platform 18 will either be in direct contact with an electrical ground, such as, for example, the Earth, or imminently at risk of direct or indirect contact therewith.

Referring particularly to FIG. 2, the control assembly 20 is operable to transmit and implement a control input provided by the worker to move the boom 16 or position the work station 14. The control assembly 20 may use any suitable mechanism to accomplish its function, including, for example, mechanical, electrical, fluidic, or pneumatic mechanisms. As illustrated, the bucket truck 12 uses a conventional fluidic mechanism, comprising one or more hydraulic control valves 40, one or more fluid conduits 42, and a quantity of hydraulic fluid, to transmit the control input down the boom 16 for implementation. Because the control valves 40 must be physically connected to the fluid conduits 42, the control valves 40 are prevented from being located inside the workstation 14 and its protective liner 32. Thus, the control valves 40, which are themselves typically constructed of metal or other electrically conductive material, must be located in relatively close proximity to the electrically conductive structural support material 25 used to reinforce the distal end 24 of the boom 16.

Figure 3:
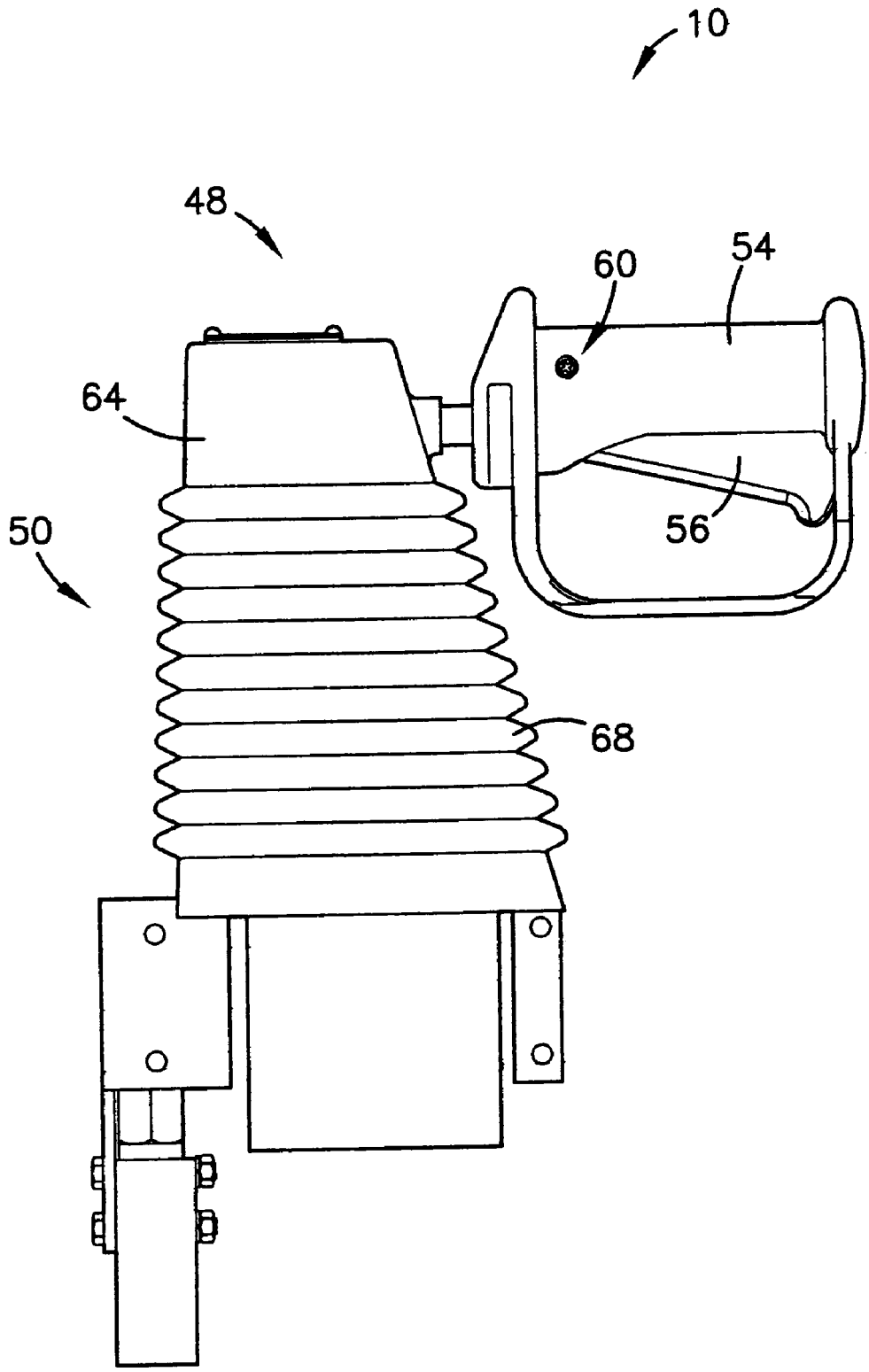
FIG. 3 is an elevation view of the preferred first embodiment of FIG. 2.
Figure 4:
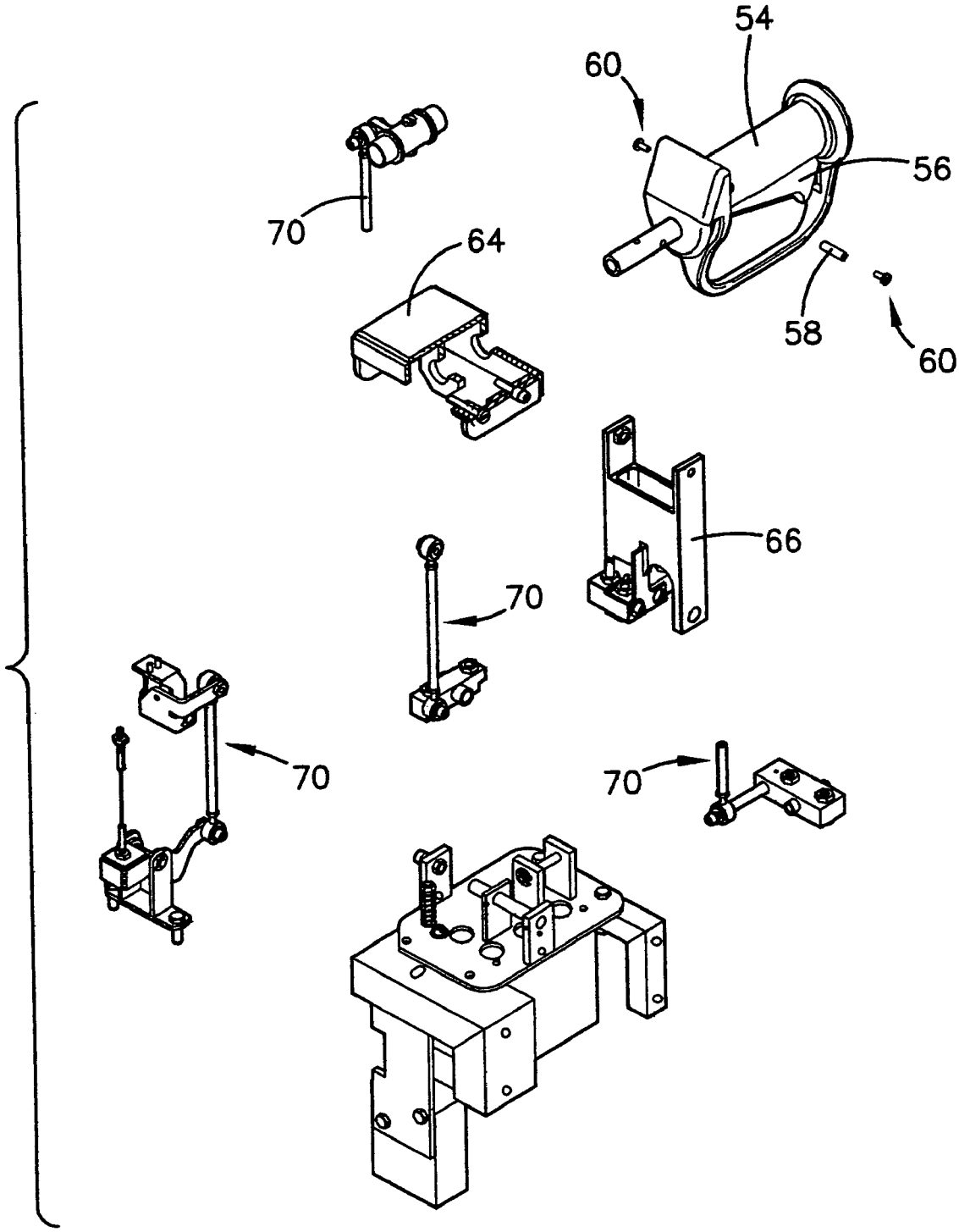
FIG. 4 is an exploded isometric view of the preferred first embodiment of FIG. 2.

Referring particularly to FIGS. 2, 3, and 4, the preferred first embodiment of the isolation mechanism of the present invention takes the form of the improved control input mechanism 10 operable to allow the worker to provide the aforementioned control input to the control assembly 20 while protecting against electrical discharge therethrough. The improved control input mechanism 10 broadly comprises a control handle 48 and a control linkage 50. The control handle 48 is grasped by the worker and actuatable to produce the control input. The linkage 50 couples the control handle 48 with the control valves 40 and operates to transmit the control input therebetween for implementation. Typically, the boom 16 will be movable and the work station 14 will be positionable in two directions along all three dimensions, for a total of six different potential control inputs (i.e., up, down, right, left, back, forth). The control handle 48 and linkage 50 should be configured so as to allow the worker to provide each of these six different control inputs with one hand. Those with ordinary skill in the art will recognize that control input mechanisms having such functionality are well-known.

In the present invention, however, portions of the control handle 48 and the linkage 50 are constructed of or covered with an electrically non-conductive material so as to provide a dielectric gap separating the control handle 48 from the electrically conductive structural materials 25 and the electrically conductive control valves 40, thereby substantially reducing or eliminating any risk of electrical discharge along these paths.

The internal workings of the improved control input mechanism 10, shown in FIGS. 3 and 4, are substantially conventional and will be understood by those with ordinary skill in the art without elaboration. As illustrated, those portions of the control handle 48 constructed of or covered with an electrically non-conductive material in accordance with the preferred first embodiment of the present invention include a grip 54; an actuator lever 56; and a standoff 58 and a plurality of associated machine screws 60. These portions are otherwise conventional. As illustrated, those portions of the linkage 50 constructed of or covered with an electrically non-conductive material include a top cap 64; pivoting frame 66; boot 68; and a plurality of links 70. These portions are also otherwise conventional. Such construction of at least the identified portions of the control handle 48 and the linkage 50 in the illustrated improved control input mechanism 10 will result in the desired electrical isolation.

It will be appreciated that the present invention is not limited to the illustrated improved control input mechanism 10, but is instead applicable to any implementation or embodiment of a control input mechanism having a control handle and a linkage, or the equivalent thereof, such that appropriate portions thereof may be constructed of or covered with an electrically non-conductive material so as to provide the desired electrical isolation.

Thus, it will be appreciated that the improved control input mechanism 10 provides a dielectric gap which electrically isolates the control handle 48 from the electrically conductive control valves 40 and the electrically conductive material 25 of the distal end 34 of the boom 16, wherein the gap is sufficient to substantially protect against phase-to-phase and phase-to-ground electrical discharges along these paths. Preferably, the dielectric gap provided by the improved control input mechanism 10 is testable to ensure the continued integrity of its non-conductive qualities and resistance to current flow. One such test might include, for example, periodically applying an electric potential to each end of the linkage 50 and measuring any leakage current.

In exemplary use and operation, the worker located in the work station 14 reaches outside of the protective sleeve 32 to manipulate the control handle 48 to provide a control input for elevating the boom and the work station 14. The control signal is transmitted in a mechanical manner via the linkage 50 to the control valves 40. The control valves 40 affect the hydraulic fluid in the fluid conduits 42 so as to transmit the control input down the boom 16 to the base end 34 thereof. At the base end 34 of the boom 16 are conventional mechanisms for implementing the control input and elevating the boom 16.

While elevated and working on a first phase or ground conductor 28, however, a strong gust of wind blows a second conductor 26 against the conductive material 25 of the distal end 24 of the boom 16. If the bucket truck 12 were equipped only with prior art isolation mechanisms, the worker might then be electrocuted. Because the aerial device 12 is equipped with the improved control input mechanism 10 of the present invention, however, the electrical discharge path is broken by the dielectric gap so that no discharge occurs and the worker is safe.

Figure 5:
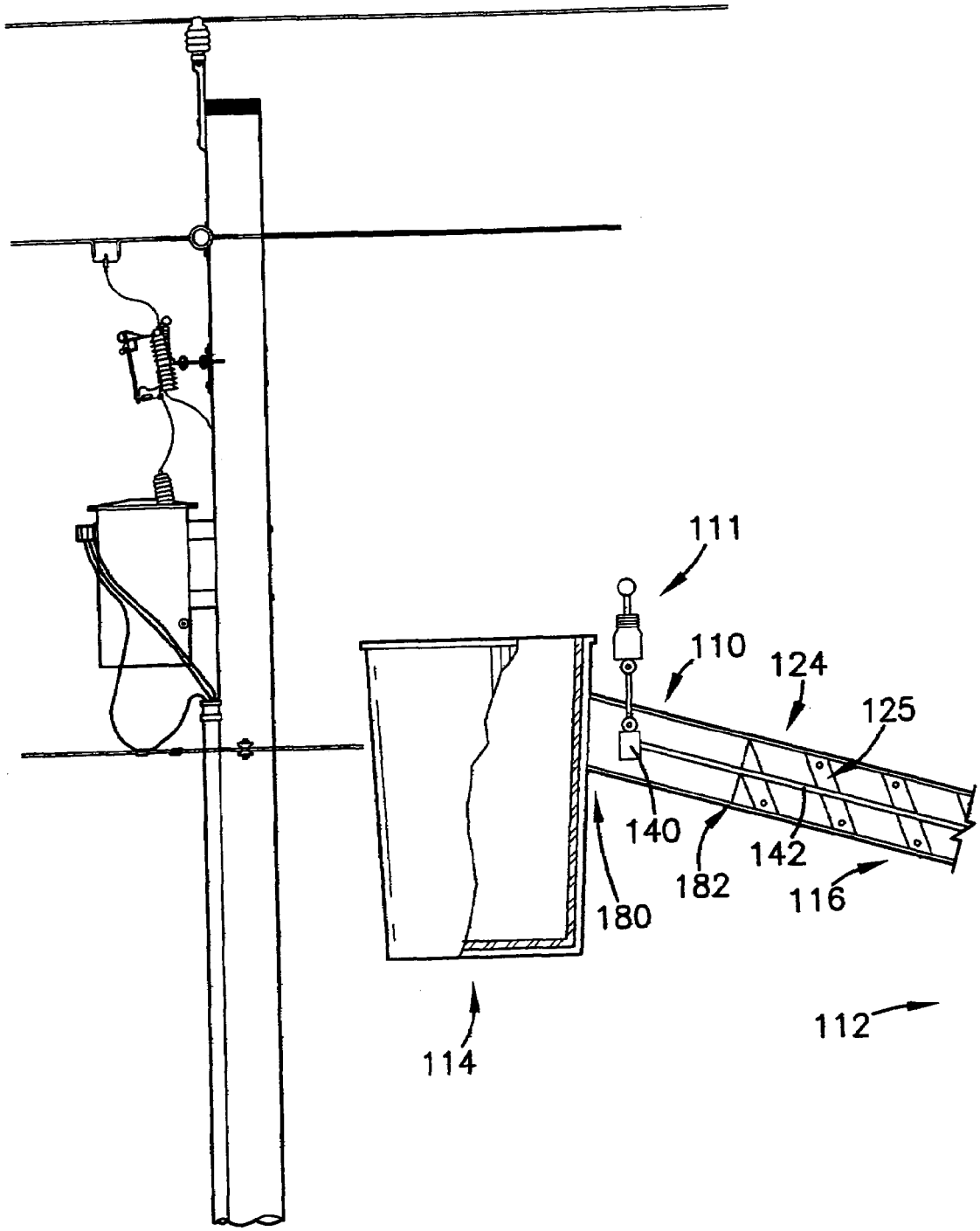
FIG. 5 is a fragmentary sectional view showing a preferred second embodiment of the isolation mechanism of the present invention as it relates to the bucket truck of FIG. 1.

Referring to FIGS. 1 and 5, in the preferred second embodiment of the present invention, the isolation mechanism takes the form of a boom extension 110. The boom extension 110 may be used on any otherwise conventional boomed apparatus, such as, for example, the above-described common bucket truck 112. The boom extension 110 is operable to allow a worker to control movement of the boom 116 and positioning of the work station 114 while protecting against electrical discharge along substantially any path which includes the control input mechanism 111. In this second embodiment, the control input mechanism 111 may be completely conventional, having no specific components constructed of or covered with electrically non-conductive material, and therefore not providing the electrical isolation of the preferred first embodiment described above.

The boom extension 110 is constructed of or covered with an electrically non-conductive material, and presents a first end 180 and a second end 182. The dimensions and other design considerations of the boom extension 110 will depend upon the weight, including that of the work station 114 and of the worker, to be supported, as well as other considerations which will be readily recognizable by those with ordinary skill in the art. It will be appreciated, however, that the boom extension 110 does not support the weight of the boom 16 and can therefore be constructed without the electrically conductive structural materials needed in the boom 16. The first end 180 is coupled with the work station 114 and the second end 182 is coupled with the distal end 124 of the boom 116 so as to provide a dielectric gap between the work station 114 and the electrically conductive material 125 of the boom 116. The control input mechanism 111 and the control valves 140 are located on the same side of the dielectric gap as the work station 114. The fluid conduits 142, being effectively electrically non-conductive, extend through the boom extension 110 and on through the boom 116.

Thus, both the control input mechanism 111 and the electrically conductive control valves 140 are electrically isolated from the electrically conductive material 125 of the distal end 134 of the boom 116 by the electrically non-conductive boom extension 110 and the electrically non-conductive fluid conduits 142.

Referring again to FIG. 1, in a third embodiment of the present invention, the isolation mechanism combines the improved control input mechanism 10 of the first embodiment, including the control handle 48 and linkage 50 constructed of or covered with electrically non-conductive materials, with the boom extension 110 of the second embodiment to provide double protection against electrical discharge or electrocution through any path including the control input mechanism 10.

From the preceding description, it will be appreciated that the present invention provides substantial advantages over the prior art, including, for example, that the worker is protected against electrical discharge along substantially all paths which include the control input mechanism and, more particularly, the control handle. This is a substantial improvement over the prior art which protects only against electrical discharge via the boom and vehicle platform.

Although the invention has been described with reference to the preferred embodiment illustrated in the attached drawings, it is noted that equivalents may be employed and substitutions made herein without departing from the scope of the invention as recited in the claims. Thus, for example, though described herein as being used on a common bucket truck, the isolation mechanism, in its various embodiments, may be used on substantially any boomed apparatus. Furthermore, as mentioned, the improved control mechanism of the first embodiment and the boom extension of the second embodiment may be used alone or in combination in a third embodiment.

Having thus described the preferred embodiment of the invention, what is claimed as new and desired to be protected by Letters Patent includes the following:

1. An isolation mechanism for a boomed apparatus, wherein the boomed apparatus includes a movable boom and a control assembly comprising substantially electrically conductive control valves located at a general distal end of the boom, the isolation mechanism comprising:

a substantially electrically non-conductive control handle actuatable by a worker to provide a control input; and a linkage configured for positioning proximate to the distal end of the boom and substantially external to the boom, the linkage operable to couple the control handle with the control assembly so as to communicate the control input therebetween, the linkage further including an elongated rod assembly that is substantially electrically non-conductive, such that when positioned external to the boom, the linkage provides a dielectric gap between the control handle and the movable boom to substantially electrically isolate the control handle from the control assembly and the movable boom to thereby prevent bodily injury to the worker.

2. An isolation mechanism for a boomed apparatus, wherein the boomed apparatus includes a movable boom having a periphery and a control assembly comprising a substantially electrically conductive control valve assembly carried by the boom at a general distal end of the boom, the isolation mechanism comprising:

a substantially electrically non-conductive control handle having a length; and a substantially electrically non-conductive linkage coupled with the control handle and configured for coupling with the control valve assembly whereupon the linkage extends beyond a periphery of the boom, wherein a length of the linkage is approximately greater than the length of the control handle.

3. The isolation mechanism as set forth in claim 2, the linkage further comprising at least one elongated link constructed of an electrically nonconductive material.

4. An isolation mechanism configured for coupling with a boomed apparatus comprising a movable boom and a control assembly, the isolation mechanism comprising:

means for providing control input to the boom when the isolation mechanism is coupled with the boom; and means for producing a dielectric gap between the means for providing control input to the boom and the movable boom when the isolation mechanism is coupled with the boom.

* * * * *